United States Patent [19]

McLaughlin

[11] Patent Number: 4,879,820

[45] Date of Patent: Nov. 14, 1989

[54] APPARATUS FOR REMOVING WATER FROM THE GROUND

[75] Inventor: Hugh R. McLaughlin, Dublin, Ireland

[73] Assignee: Zestful Holdings Limited, Douglas, Isle of Man

[21] Appl. No.: 227,574

[22] Filed: Aug. 3, 1988

[51] Int. Cl.[4] ..... E01H 1/00

[52] U.S. Cl. ..... 34/71; 34/95; 34/95.3; 15/98; 15/119 A

[58] Field of Search ..... 34/71, 95, 95.3; 15/98, 15/119 A

[56] References Cited

U.S. PATENT DOCUMENTS 4,542,594 9/1985 McLaughlin ..... 34/71

*Primary Examiner*—Henry A. Bennett

*Attorney, Agent, or Firm*—Sughrue, Mion, Zinn, Macpeak and Seas

[57] ABSTRACT

An apparatus for removing water from the ground comprises at least one ground-engaging drum including a hollow cylinder mounted for rotation about a substantially horizontal axis, and a plurality of recesses substantially parallel to the rotational axis of the cylinder formed in the outer surface of the cylinder around the periphery thereof. A non-porous sheet of resilient material covers the outer surface of the cylinder, and a plurality of slits are cut in the covering sheet over the recesses in the cylinder. The slits are normally closed but are capable of opening under the pressure of water built up in front of the drum, as the latter is moved across the ground, to permit such water to enter the recesses in the region of ground contact. The slits close away from the region of ground contact to retain the water in the recesses, and apertures in the recesses permit water retained therein to discharge into the interior of the cylinder at a certain height within the cylinder for collection in a water tank within the cylinder.

10 Claims, 8 Drawing Sheets

APPARATUS FOR REMOVING WATER FROM THE GROUND

Figure 1:
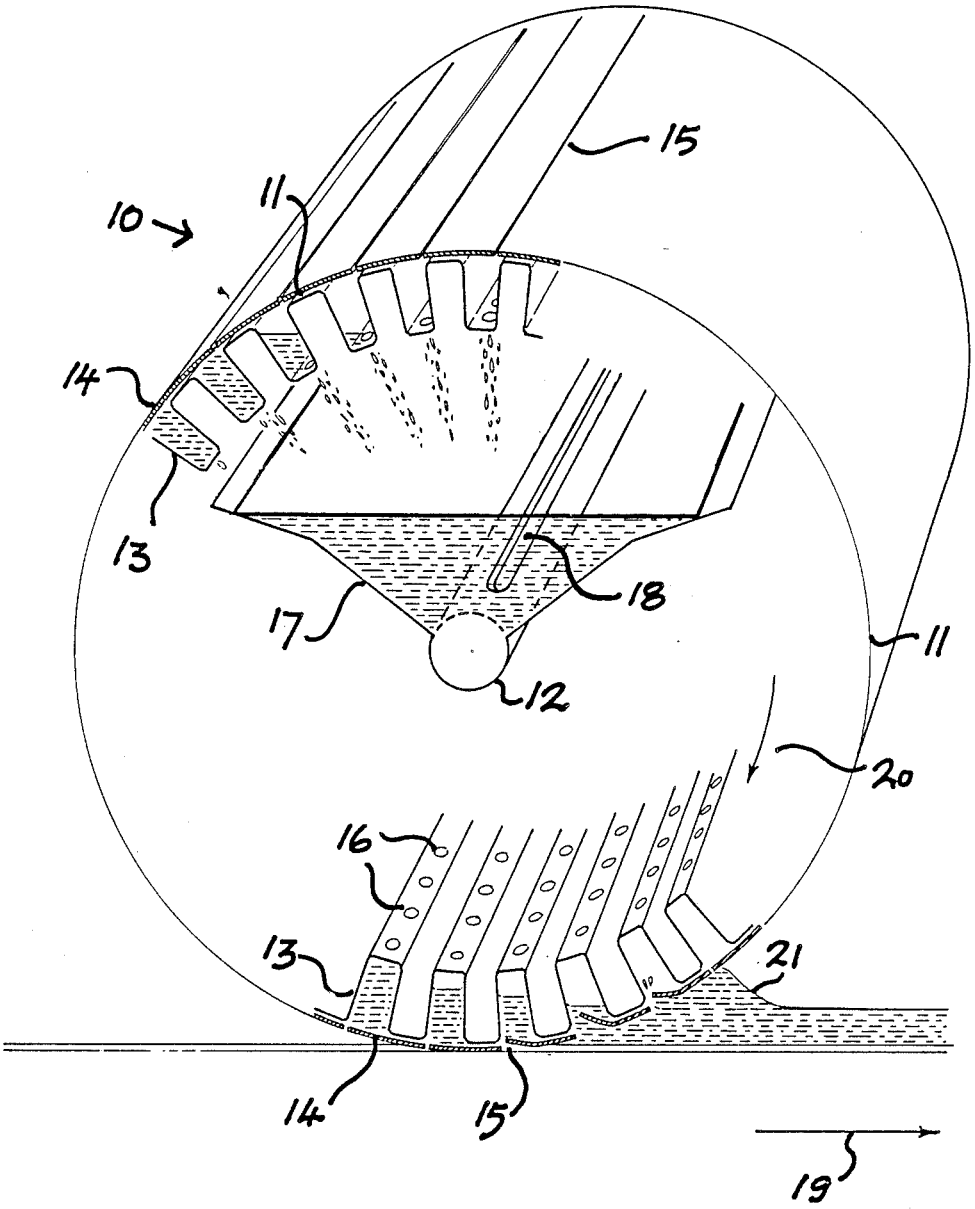

This invention relates to an apparatus for removing water from the ground, and is a modification of the apparatus described and claimed in Irish Pat. Application No. 576/84 whose contents are hereby incorporated by reference.

Briefly, the apparatus described in the above Irish Pat. Application comprises a ground-engaging drum including an apertured hollow cylinder, a layer of open-cell foam material covering the cylinder, valves inside the cylinder for trapping water therein which enters through the apertures in the region of ground contact, and a non-rotating water tank in the cylinder into which the trapped water is discharged, the water being lifted to the tank by a plurality of fabricated troughs on the inside surface of the cylinder.

The prior art apparatus is dependent on the water getting through a perforated steel drum before making contact with its internal valves. It is also dependent on the use of foam with or without an outer rubber covering which makes it relatively unsuitable for rapid or extensive movement across hard or rough ground, such as farms, builders yards etc, or moving over pathways from one grassy area to another for water removal, so that movement from one such area to another has to occur relatively slowly. Even then, the foam has to be replaced regularly. It cannot collect water from grounds such as American Baseball "in field" areas which are covered by clay rather than being grass covered.

In the case of a machine with two or more drums it is necessary for it to have a centrally situated external tank fixed between front and rear drums. This necessitates its dependence on gravitational water flow from both drums which compared to direct water pump suction greatly reduces the volume of water collection and disposal.

The perforated steel drum, with its internal valves and its separately fabricated troughs, and numerous components is relatively expensive to manufacture.

Therefore it is an object of the present invention to provide a water removal apparatus in which these disadvantages are mitigated.

According to the present invention there is provided an apparatus for removing water from the ground, comprising at least one ground-engaging drum including a hollow cylinder mounted for rotation about a substantially horizontal axis, a plurality of recesses substantially parallel to the rotational axis of the cylinder formed in the outer surface of the cylinder around the periphery thereof, a non-porous sheet of resilient material covering the outer surface of the cylinder, a plurality of slits in the covering sheet over the recesses in the cylinder, such slits normally being closed but being capable of opening under the pressure of water built up in front of the drum, as the latter is moved across the ground, to permit such water to enter the recesses in the region of ground contact, the slits closing away from the region of ground contact to retain the water in the recesses, and apertures in the recesses to permit water retained therein to discharge into the interior of the cylinder at a certain height within the cylinder, the apparatus further including means within the cylinder for collecting water discharged from the recesses.

An advantage of the invention is that the drum may be manufactured much more cheaply than the prior drum, since the need for internal valves and troughs in the cylinder is eliminated. Furthermore, the cylinder may be made by rotational moulding from polyethylene or like rigid plastics material, giving a lightweight structure. It will be appreciated that the presence of the recesses will give considerable strength to the cylinder, thus avoiding the need for rigid metal structures.

A further advantage is that since the resilient sheet covering does not have to be of open-cell foam or foam-like material, it may be made of a strong and wearable material such as closed-cell neoprene, resulting in a longer life to the apparatus before the cylinder covering needs to be changed.

Naturally, if desired, the non-porous resilient sheet covering can itself be covered by a layer of open-cell foam where the apparatus is only required to cover grass at relatively low speeds, and for protection in such case the foam layer may further be covered by an outer layer of rubber. Such outer layer of protective rubber would only need to be apertured in rows directly over the recesses in the cylinder.

Preferably, in the direction through the thickness of the covering sheet the slits are inclined to the radial direction of the cylinder, most preferably at about 45 degrees to the radial direction. The 45 degree slits, considered in the direction from the outside of the sheet to the inside of the sheet in the region of ground contact, are inclined towards the rear relative to the forward direction of travel of the drum. As will be described, this facilitates opening of the slits under the pressure of external water, yet resists opening under the weight of water retained in the recesses.

Further strength to the drum may be provided by forming the cylinder with a slight camber, that is, by making the cylinder slightly curved with the diameter of the cylinder being very slightly greater at the centre than at the axially opposite ends. This also permits the drum to be steered more easily and avoids outer edge marking on golf greens.

In order to prevent the accumulation of mud on the drum, the apparatus may comprise a cleaning brush extending substantially the full axial length of the drum and which is arranged for counter-rotation relative to the drum. This is only possible because of the drum's ability to take up water without the use of foam which would not stand up to the friction of a revolving brush.

The water collecting means may comprise a nonrotating water tank within the cylinder, the cylinder being mounted for rotation on a fixed axle, and the axle being at least partly hollow to permit water to exit from the water tank via the hollow axle.

The apparatus may include two drums as aforesaid mounted on a common chassis frame, each cylinder being rotatable about a respective fixed at least partly hollow axle, and a fluid connection between one hollow axle to the other, whereby water in one water tank fixed above its axle will drain under gravity into the second water tank fixed below its axle, the apparatus further including means for pumping water from the second water tank to the external environment.

This avoids the need to provide an external main water tank or more than one water removal means (pump), and the principle may be extended to more than two drums. It also reduces the dimensions and weight of the machine and also greatly increases the volume and speed of water disposed as it is pumped directly from its main (front) drum immediately it is collected.

Figure 2:
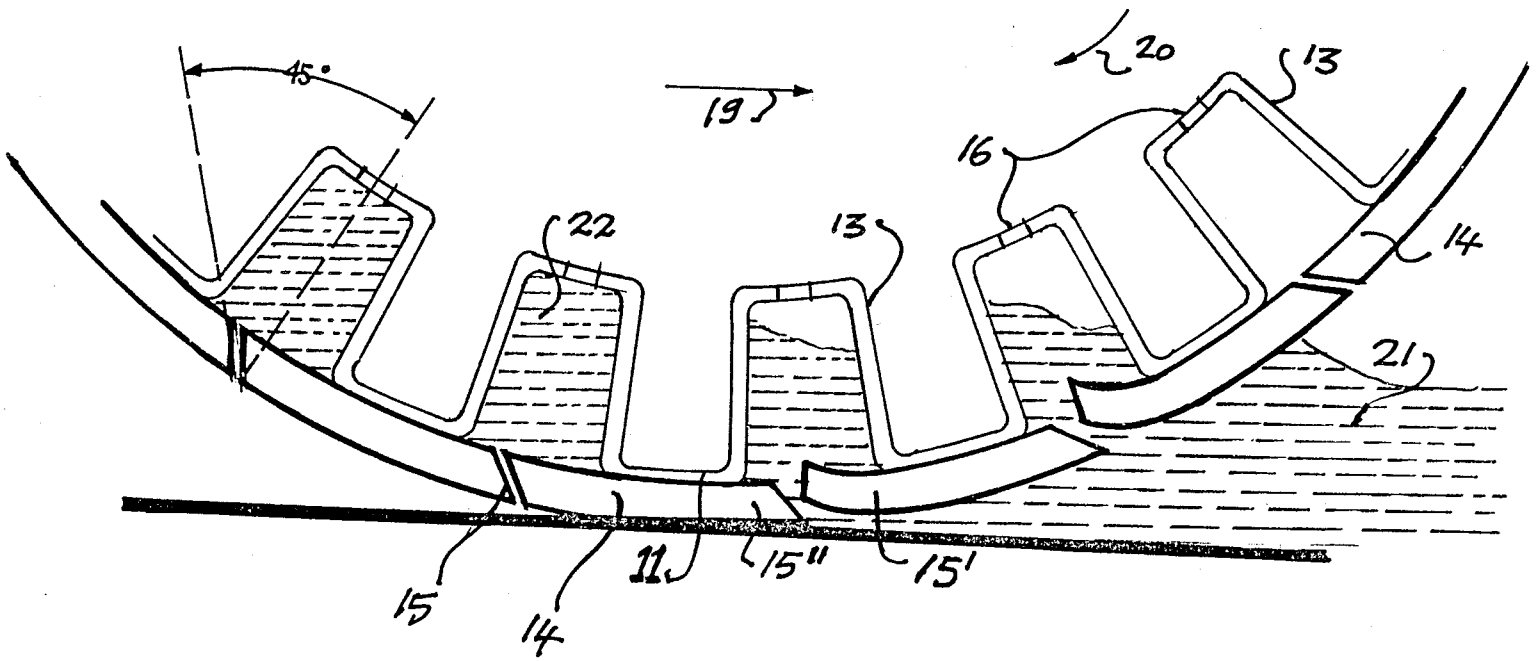
Figure 3:
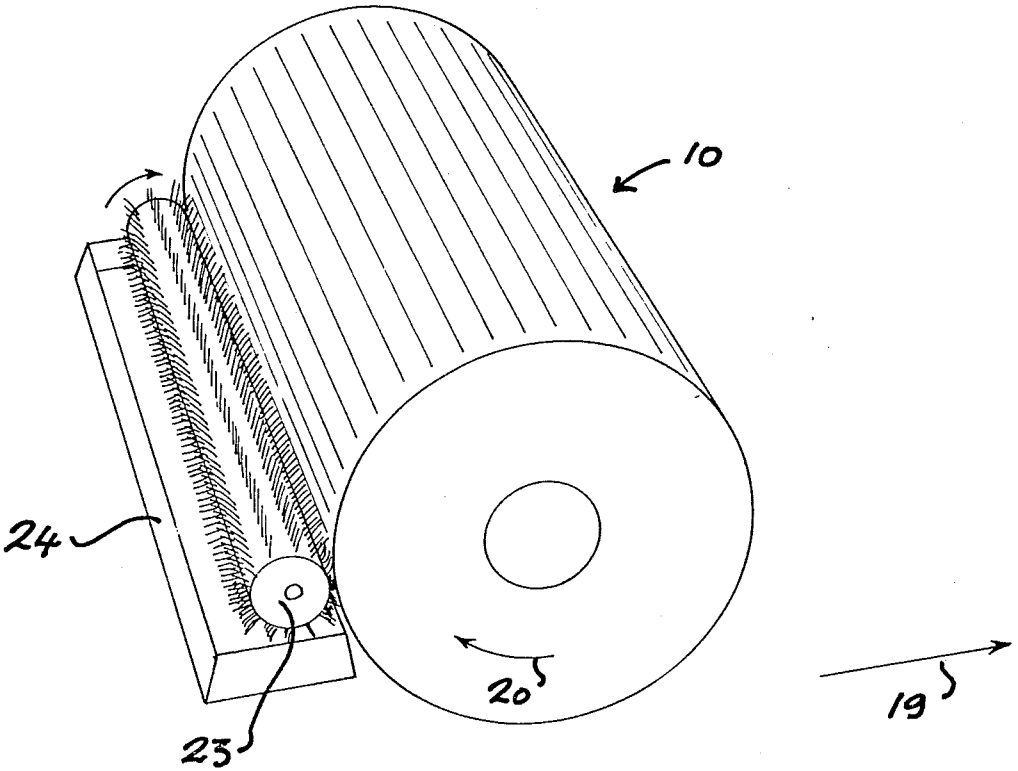
Figure 4:
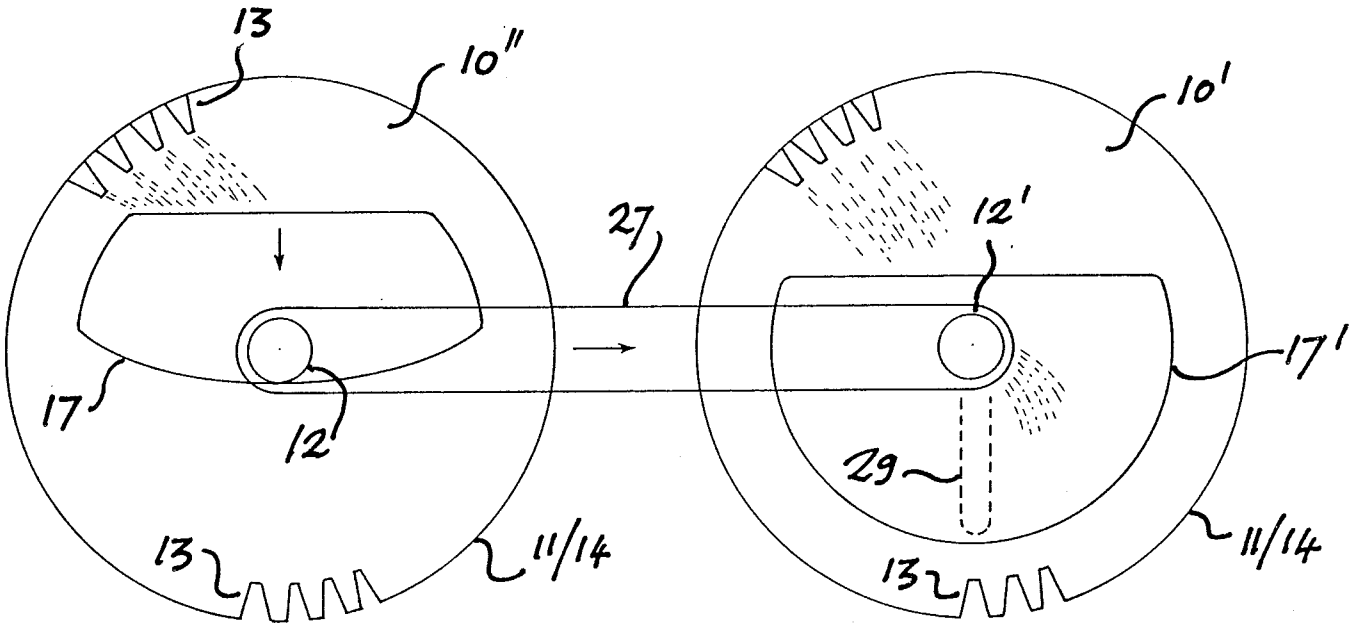
Figure 5:
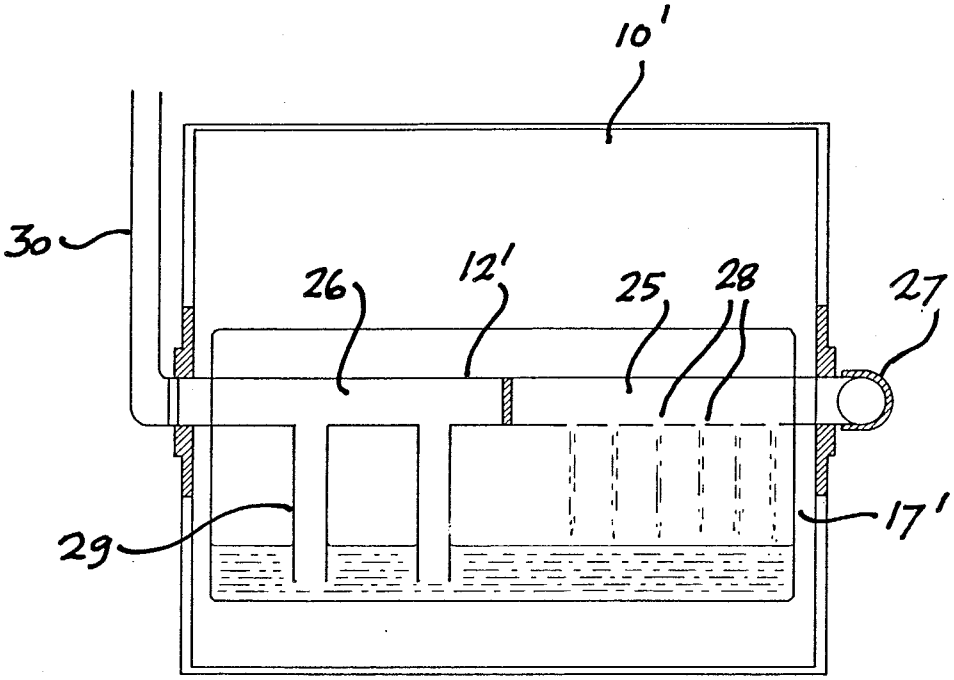
Figure 6:
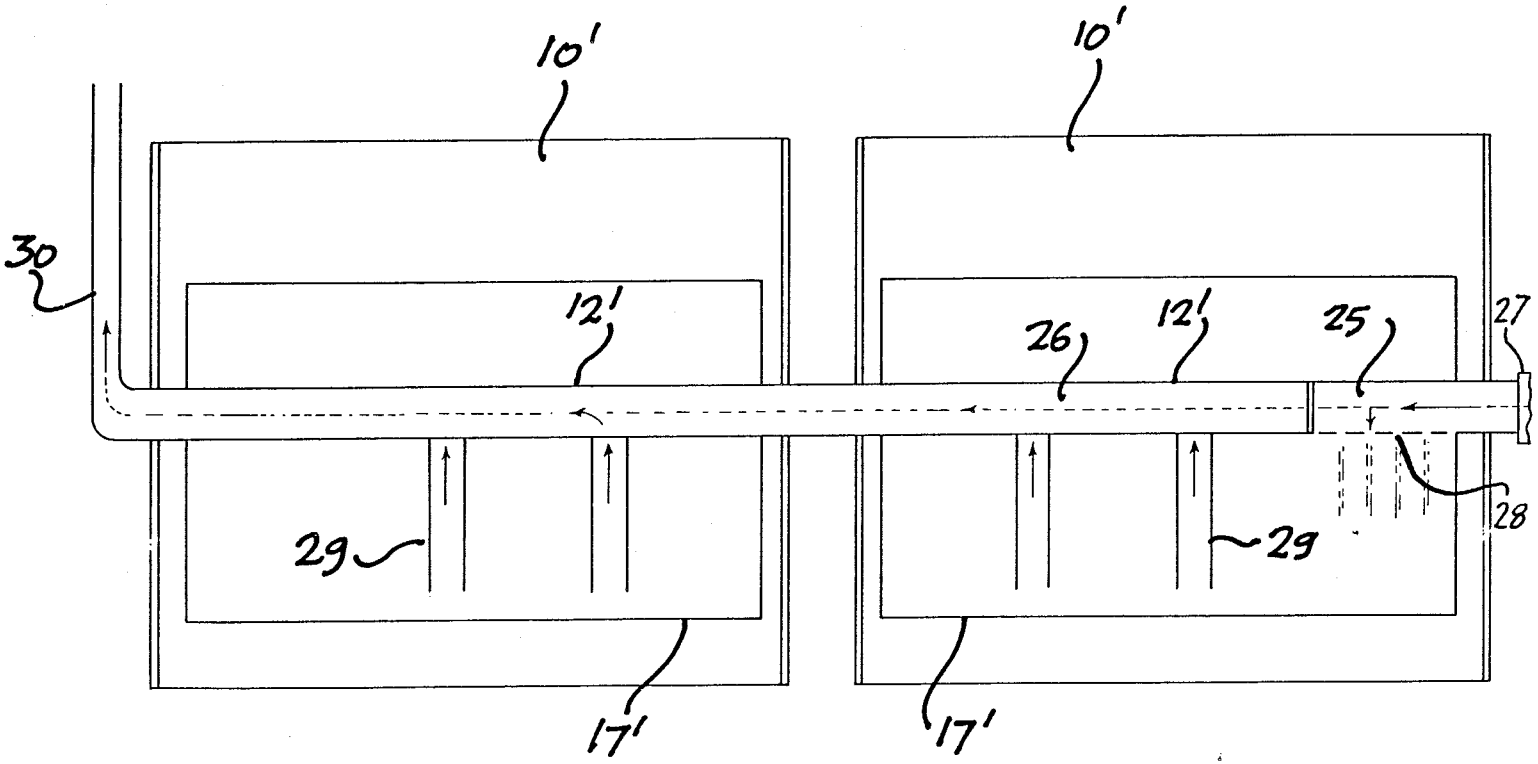
Figure 7:
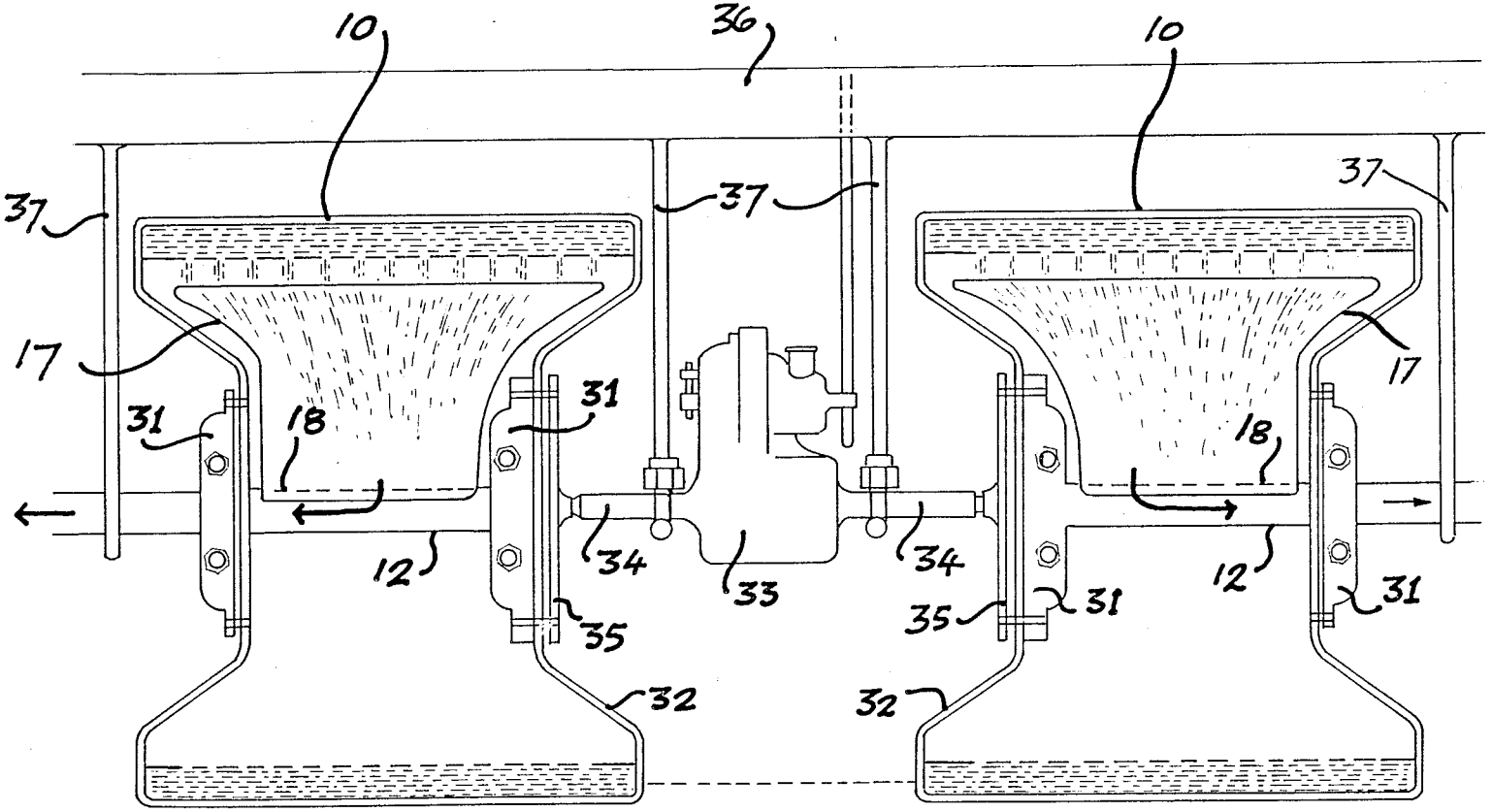
Figure 8:
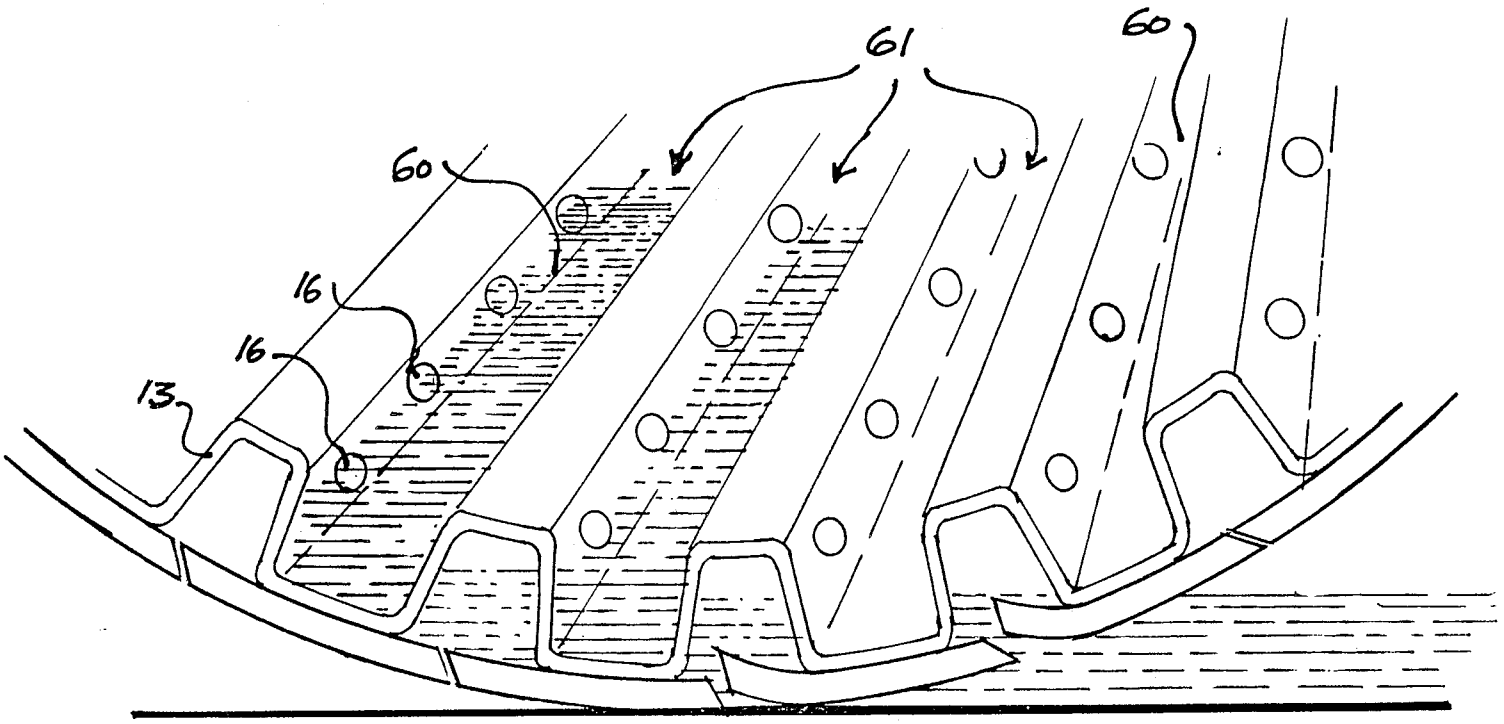

Embodiments of the invention will now be described, by way of example, with reference to the accompanying Drawings, wherein:

FIG. 1 is a cross-section perspective view of a drum forming part of an apparatus according to a first embodiment of the invention, FIG. 2 is an enlarged detailed cross-sectional view of part of the periphery of the drum of FIG. 1, FIG. 3 shows the drum of FIGS. 1 and 2 with a counter-rotating cleaning brush, FIG. 4 is a schematic side view of a second embodiment of the invention where front and rear drums are used and the water from the rear drum drains from a tank placed above its axle into the tank in the front drum which is fixed below its axle and is removed from the latter by pumping, FIG. 5 is a front cross-sectional view of the front drum of FIG. 4, FIG. 6 is a front cross-sectional view of a third embodiment of the invention wherein two front drums are provided side-by-side, FIG. 7 illustrates a drive system for a pair of side-by-side drums; and FIG. 8 illustrates another embodiment of the invention.

FIGS. 1 and 2 illustrates a water-collecting drum 10 forming part of an apparatus according to a first embodiment of the invention. It is to be clearly understood that FIGS. 1 and 2 do not show the complete apparatus. However, such apparatus may, apart from the ground-engaging drum 10, the use of an external tank and its direct means of pumping water, be constructed substantially as described in the abovementioned Irish Pat. Application No. 576/84, with the drum 10 of the present description substituted for that shown in the prior Pat. Application. Thus it is not believed necessary to repeat the details of the supporting chassis frame and drum-rotation means in the present Specification.

The ground-engaging drum 10 includes a hollow cylinder 11 preferably 20" to 25" in diameter mounted for rotation about the axis of a substantially horizontal hollow axle 12. The axle 12 is non-rotatably fixed at opposite ends to the chassis frame of the apparatus, and the cylinder 11 is rotatably mounted on the fixed axle 12 by bearings at each axial end of the cylinder, such as is shown in FIG. 3 of the abovementioned Irish Pat. Application.

A plurality of recesses 13 substantially parallel to the rotational axis of the cylinder are formed in the outer surface of the cylinder around the periphery thereof, the recesses being typically 2" deep and representing about 25% of the cylinder surface.

A non-porous sheet 14 of resilient material is stretched around and covers the outer surface of the cylinder 11, for example a sheet of closed-cell noeprene having a thickness of up to about ¼". Such material is compressible, strong and wear resistant. However, other resilient materials such as rubber or PVC may be used in different thicknesses. The sheet 14 may be retained in position on the cylinder by its own resilience, or an adhesive may be used to fix the sheet to the periphery of the cylinder in the non-recessed areas.

Thereafter, a plurality of slits 15 are cut in the sheet 14 over the recesses 13 in the cylinder 11, the slits being orientated in the same direction as the recesses. There may be one or a series of slits 15 along the length of each recess 13.

The slits 15 are normally held closed by the resilient stretching of the sheet 14, but as will be described they are capable of opening under the pressure of water built up in front of the drum, as the later is moved across the ground, to permit such water to enter the recesses in the region of ground contact. However, as the slits 15 move away from the region of ground contact they re-close to retain the water in the recesses 13. Accordingly, the slits 15 act as one-way valves.

The recesses 13 are provided with apertures 16 to permit water retained therein to discharged into the interior of the cylinder 11 at a certain height within the cylinder. Such water is collected in a non-rotating water tank 17 within the cylinder, the water tank being supported by the fixed axle 12. Water may exit from the cylinder 11 through the hollow axle 12 which communicates with the bottom of the tank 17 by a slot 18.

A more detailed view of part of the drum 10 (in the region of ground contact) is shown in FIG. 2, wherein it is seen that in the direction through the thickness of the covering sheet 14 the valve slits 15 are inclined to the radial direction of the cylinder 11, most preferably at about 45 degrees to the radial direction.

The 45 degree slits, considered in the direction from the outside of the sheet 14 to the inside of the sheet in the region of ground contact, are inclined towards the rear relative to the forward direction of travel of the drum 10. As will be described, this facilitates opening of the slits 15 under the pressure of external water, yet resists opening under the weight of water retained in the recesses. The forward direction of the drum 10 is indicated in FIGS. 1 and 2 by the arrow 19, such motion being brought about by rotation of the drum 10 in the direction of the arrow 20 by the drive means not shown but described in the abovementioned Irish Patent Application.

The cylinder 11 may be made by rotational moulding from polyethylene or like rigid plastics material, giving a lightweight structure. It will be appreciated that the presence of the recesses 13 will give considerable inherent strength to the cylinder, thus avoiding the need for rigid metal structures.

Further strength to the drum may be provided by forming the cylinder 11 with a slight camber, that is, by making the cylinder slightly curved with the diameter of the cylinder being slightly greater at the centre than at the axially opposite end. This also permits the drum to be steered more easily in use.

Such a camber may be provided by setting a steel ring around the centre of the inside circumference of the mould used to make the cylinder. The ring is typically 2" wide by 18" in diameter, and is so positioned inside the mould prior to forming the cylinder as to become integrally moulded into the cylinder.

The camber is formed by the fact that as the polyethylene cools it tends to shrink slightly away from the mould. The centrally located steel ring prevents this at the centre of the cylinder, so that on each side of the centrally located ring the polyethylene shrinks away to form a rounded curve to the cylinder surface in the axial direction thereof. This process typically produces a cylinder 11 having a diameter of 22" at the centre reducing to 21.5" at each end.

The cylinder 11 is closed at each end by end plates (not shown) of 22" diameter, one such plate being moulded with the cylinder and the other welded or otherwise fixed to the opposite open end of the cylinder and being made of the same or different material as the cylinder. The completed cylinder is therefore structurally strong yet of light weight. It will be understood that the cylinder is rotatablty mounted on the fixed axle 12 by suitable bearings (not shown) provided centrally in these end plates.

In use, the drum 10 is driven in the direction of the arrow 19, FIG. 1, by rotation of the cylinder 11 in the direction of the arrow 20. The slits 15 are normally held closed by the resilience of the sheet 14, as shown at the far right of FIG. 2. However, in the region of ground contact, the build up of water 21 in front of the drum 10 exerts a radially inward pressure on the sheet 14, causing the slits 15 to open, as shown for the second and third slits from the right in FIG. 2.

In addition to the action of the normal flow and wave build up the water 21 is forced into the recesses 13 associated with the open slits by the oncoming solid wall of each recess which also traps the water when the leading edge of the recess makes contact with the ground. In the region of ground contact, the ¼" sheet 14 is compressed to about 1/16" . This provides for efficient water removal along the full width of the drum 10, by preventing the escape of trapped water beneath the drum and by squeezing out the water from under the non-recessed areas.

When each recess passes to the rear of the region of ground contact, the radially inward pressure on the slits 15 is relieved so that they close again due to their inherent resilience and the weight of water — see for example the slits on the left hand side of FIG. 2. Thus the water 22 which entered the recesses is trapped and retained therein.

The water 22 in the recesses 13 is then carried rearwardly and upwardly inside the cylinder 11, until each recess 13 reaches such a height that the water can discharge from the recess through the apertures 16 in the base thereof. This is designed to occur when each recess 13 is substantially over the water-collecting tank 17, so that the water is discharged into the tank 17. From the tank 17 the water may leave the drum 10 by gravity drainage via the slot 18 and hollow axle 12.

It will be observed that the inclination of the slits 15 as shown in FIG. 2 permits easy inward opening of the side 15' of the slits under the influence of front and inward water pressure, but resists outward opening of the side 15" of the slits under the weight of water retained in the recesses, and this is enhanced by locating each slit 15 more towards the rear wall of the recess, as referred to the direction of forward motion.

To prevent the accumulation of mud and sticky dirt on the drum 10, the apparatus may comprise a cleaning brush 23 (FIG. 3) extending substantially the full axial length of the drum and which is driven for counter-rotation relative to the drum by means (not shown) coupled to the same power source which drives the drum. If required a fixed tray 24, carried by the chassis frame which supports the drum and drive means, is located immediately below the brush 23 to collect the mud and dirt removed from the drum by the brush.

As shown in FIGS. 4 and 5, the apparatus may include front and rear drums 10' and 10" respectively mounted on a common chassis frame (not shown). Each cylinder 11 is rotatable about a respective fixed hollow axle 12 or 12', the rear axle 12 being the same as that previously described, but the front axle 12' being divided into two isolated parts 25 and 26 respectively.

The front axle 12' is at the same level as the rear axle 12, and the part 25 of the front axle 12' is connected to the rear axle 12 by a water conduit 27. The water tank 17 in the rear cylinder is fixed around and above the axle 12 whereas the tank 17' in the front cylinder is fixed around and below the axle 12'. Accordingly, water in the rear water tank 17 will drain under pressure into the front water tank 17', which is at a lower level than the rear tank 17, via apertures 28 in the part 25 of the front axle 12'.

The front tank 17' therefore collects water from both drums, and the water collected therein is removed by suction through an external pipe 30 connected to the split axle part 26 of the front axle 12' which has branches 29 extending downwardly to the bottom of the tank 17'.

The same principle may be applied where there are two front drums 10' arranged side by side, FIG. 6. However, in that case only one of the front hollow axles 12' needs to be separated in the manner of FIG. 5, being the right hand axle in the Figure.

Water from the rear drum enters the tank 17' of the right hand front drum via the conduit 27 and part 25 as before, and is drawn out via the extensions 29, part 26 and pipe 30. However, the part 25 of the right hand axle 12' is not directly connected to the pipe 30, but via the left hand axle 12', which likewise has extensions 29 to the bottom of its own tank 17'. Therefore, a common external pump (not shown) removes the water indirectly from the rear drum and from the right hand front drum and directly from the left front drum.

Naturally, this principle may be extended to the case where there are two rear drums with connected axles which feed the front drums via a common conduit 27.

The above described embodiments of the invention have assumed that the drum(s) 10 are driven substantially in the manner described in the abovementioned Patent Application, i.e. by a motor mounted on the chassis frame which drives the drums indirectly via chains and sprocket wheels. FIG. 7 shows an alternative arrangement.

In FIG. 7, the two drums 10 shown are assumed to be the front drums of an apparatus having two front drums and a single rear drum, or vice versa. Each drum 10 is rotatably mounted on a respective fixed hollow axle 12 by bearings 31.

The end plates 32 of the drums are conically recessed to accommodate the bearings 31 and, in the case of the adjacent inner end plates of the two drums, a hydrostatic drive 33 with a direct differential drive 34 to each drum. Each drive 34 is coupled to the respective drum by a flange 35 bolted to the end plates 32.

A part of the chassis frame is shown schematically at 36, and the drums 10 are supported therefrom by members 37 which support the axles 12 and differential drives 34 as shown.

Inside each drum the respective water tank 17 is appropriately shaped to fit the contour of the drum, and as before water is drawn off through the hollow axles 12 via apertures 18 communicating the hollow interior of the axles with the respective tanks 17. Clearly, the direction of flow in each axle 12 is away from the central drive 33.

The advantage of this arrangement is compactness and reduced weight. Furthermore, the recessing of the end plates permits the drums to be brought closer together, so that, for example, two drums each 20" wide may be brought to within 12" of one another, allowing a third 20" drum to run centrally in front or behind the two drums with 4" overlap on each side. Accordingly, a 52" wide path may be dried in one pass.

Without the benefit of this arrangement, a direct hydrostatic drive would require a machine roller width of 60" which would be difficult to turn and would require wider doors and pathways.

Referring now to FIG. 8 there is shown a further embodiment of the invention in which counter-recesses in the inner surface of the cylinder, and which are defined by the recesses 13 in the outer surface of the cylinder, are indicated at 61. In this embodiment of the invention the apertures 16 are arranged alternatively, or additionally, in one side 60 of the external recesses 13 as shown. This means that water is retained in the external recesses 13 at ground level and is transferred into the adjacent internal counter-recesses 61 as the drum rotates upwardly as shown, for ultimate discharge into the water tank. This arrangement would be particularly suitable for one direction operation of the apparatus and the front drum, or drums, would be collecting the bulk water and the rear drum mainly used for drying the ground with a suitable foam cover.

This arrangement utilises all recesses (both external and internal) and has the advantage of taking the weight of the water off the valves as the drum comes off compression and also allows for a direct clearance.

I claim:

1. An apparatus for removing water from the ground, comprising at least one ground-engaging drum including a hollow cylinder mounted for rotation about a substantially horizontal axis, a plurality of recesses substantially parallel to the rotational axis of the cylinder formed in the outer surface of the cylinder around the periphery thereof, a non-porous sheet of resilient material covering the outer surface of the cylinder, a plurality of slits in the covering sheet over the recesses in the cylinder, such slits normally being closed but being capable of opening under the pressure of water built up in front of the drum, as the latter is moved across the ground, to permit such water to enter the recesses in the region of ground contact, the slits closing away from the region of ground contact to retain the water in the recesses, and apertures in the recesses to permit water retained therein to discharge into the interior of the cylinder at a certain height within the cylinder, the apparatus further including means within the cylinder for collecting water discharged from the recesses.

2. An apparatus according to claim 1, wherein in the direction through the thickness of the covering sheet the slits are inclined to the radial direction of the cylinder, said inclination, considered in the direction from the outside of the sheet to the inside of the sheet in the region of ground contact, being inclined towards the rear relative to the forward direction of travel of the drum.

3. An apparatus according to claim 2, wherein the slits are at about 45 degrees to the radial direction of the cylinder.

4. An apparatus according to claim 1, wherein the cylinder is slightly curved with the diameter of the cylinder being slightly greater at the centre than at the axially opposite ends whereby the cylinder has a slight camber.

5. An apparatus according to claim 1, wherein the recesses in the outer surface of the cylinder define counter-recesses in the inner surface of the cylinder, and the apertures are provided in one side of the recesses, so that water in the recesses is discharged into the water collecting means via the counter-recesses in the inner surface of the cylinder.

6. An apparatus according to claim 1, further comprising a cleaning brush extending substantially the full axial length of the drum and which is arranged for counter-rotation relative to the drum.

7. An apparatus according to claim 1, wherein the cylinder is moulded from a rigid plastics material.

8. An apparatus according to claim 1 wherein the water collecting means comprises a non-rotating water tank within the cylinder.

9. An apparatus according to claim 8, wherein the cylinder is mounted for rotation on a fixed axle, the axle being at least partly hollow to permit water to exit from the water tank via the hollow axle.

10. An apparatus including two drums as claimed in claim 9 mounted on a common chassis frame, each cylinder being rotatable about a respective fixed at least partly hollow axle, and the water tank in one cylinder being mounted above its respective axle and the water tank in the other cylinder being mounted below its respective axle, the apparatus further including a fluid connection from one hollow axle to the other, whereby water in the firstmentioned water tank can drain under gravity into the second water tank, the apparatus further including means for pumping water from the second water tank to the external environment.

* * * * *